US011102577B2

(12) United States Patent
Neoran et al.

(10) Patent No.: US 11,102,577 B2
(45) Date of Patent: Aug. 24, 2021

(54) STEREO VIRTUAL BASS ENHANCEMENT

(71) Applicant: WAVES AUDIO LTD., Tel Aviv (IL)

(72) Inventors: Itai Neoran, Beit-Hananya (IL); Ahikam Lavi, Kiryat Ono (IL)

(73) Assignee: WAVES AUDIO LTD., Tel Aviv (IL)

( * ) Notice: Subject to any disclaimer, the term of this patent is extended or adjusted under 35 U.S.C. 154(b) by 0 days.

(21) Appl. No.: 16/615,390

(22) PCT Filed: Jul. 23, 2018

(86) PCT No.: PCT/IL2018/050815
§ 371 (c)(1),
(2) Date: Nov. 20, 2019

(87) PCT Pub. No.: WO2019/021276
PCT Pub. Date: Jan. 31, 2019

(65) Prior Publication Data

US 2020/0162817 A1 May 21, 2020

Related U.S. Application Data

(60) Provisional application No. 62/535,898, filed on Jul. 23, 2017.

(51) Int. Cl.
*H04R 3/04* (2006.01)
*H04R 5/04* (2006.01)
*H04S 7/00* (2006.01)

(52) U.S. Cl.
CPC ..... *H04R 3/04* (2013.01); *H04R 5/04* (2013.01); *H04S 7/307* (2013.01);
(Continued)

(58) Field of Classification Search
CPC ... H04R 3/04; H04R 3/12; H04R 3/14; H04R 5/04; H04R 2430/03; H04R 2430/20;
(Continued)

(56) References Cited

U.S. PATENT DOCUMENTS 5,930,373 A 7/1999 Shashoua et al.
6,134,330 A * 10/2000 De Poortere ..... H04R 3/04 381/61

(Continued)

OTHER PUBLICATIONS

Bai et al., "Synthesis and Implementation of Virtual Bass System with a Phase-Vocoder Approach*", Journal of the Audio Engineering Society, Nov. 2006, vol. 54, No. 11, pp. 1077-1091.

(Continued)

*Primary Examiner* — Dislar Paul
(74) *Attorney, Agent, or Firm* — Oliff PLC

(57) ABSTRACT

A method for conveying to a listener a directionality-preserving pseudo low frequency psycho-acoustic sensation of a multichannel sound signal, including: deriving from the sound signal, by a processing unit, a high frequency multichannel signal and a low frequency multichannel signal, generating a multichannel harmonic signal, the loudness of at least one channel signal of the multichannel harmonic signal substantially matching the loudness of a corresponding channel in the low frequency multichannel signal; and at least one interaural level difference (ILD) of at least one frequency of the at least one channel pair of the multichannel harmonic signal substantially matching an ILD of a corresponding fundamental frequency in a corresponding channel pair in the low frequency multichannel signal; and summing the harmonic multichannel signal and the high frequency multichannel signal thereby giving rise to a psychoacoustic alternative signal.

20 Claims, 11 Drawing Sheets

(52) U.S. Cl.
CPC ..... *H04R 2430/03* (2013.01); *H04S 2400/07* (2013.01); *H04S 2420/01* (2013.01)

(58) Field of Classification Search
CPC ..... H04R 2201/403; H04S 7/307; H04S 2420/01; H04S 2400/07
USPC ..... 381/67, 17–18, 98–99, 101
See application file for complete search history.

(56) References Cited

U.S. PATENT DOCUMENTS

| | | | | |
|---|---|---|---|---|
| 8,098,835 | B2 | 1/2012 | Moon et al. | |
| 8,150,066 | B2 * | 4/2012 | Kubo | H04R 3/04 381/98 |
| 8,582,784 | B2 * | 11/2013 | Minnaar | H04R 3/04 381/98 |
| 8,615,093 | B2 * | 12/2013 | Hung | H04R 3/04 381/98 |
| 8,971,551 | B2 | 3/2015 | Ekstrand | |
| 9,794,688 | B2 * | 10/2017 | You | H04R 3/04 |
| 2007/0253576 | A1 | 11/2007 | Bai et al. | |
| 2008/0175409 | A1 | 7/2008 | Lee et al. | |
| 2008/0267426 | A1 * | 10/2008 | De Poortere | H04R 3/04 381/98 |
| 2009/0052695 | A1 * | 2/2009 | Yamada | H04R 3/04 381/101 |
| 2011/0091048 | A1 | 4/2011 | Bai et al. | |
| 2015/0146890 | A1 * | 5/2015 | Yang | H04S 7/307 381/119 |
| 2017/0127181 | A1 | 5/2017 | You | |
| 2017/0180863 | A1 * | 6/2017 | Biggs | H04R 1/1075 |

OTHER PUBLICATIONS

DAFX: Digital Audio Effects, Second Edition, Ed. Udo Zölzer, 2011, pp. 1-2, 149-169 and 238-295.

Sanjaume, Jordi Bonada, "Audio Time-Scale Modification in the Context of Professional Audio Post-production," 2002, Informàtica i Comunicaciódigital, Universitat Pompeu Fabra, Barcelona.

Ben-Tzur et al., "The Effects of the MaxxBass Psychoacoustic Bass Enhancement System on Loudspeaker Design," 1999, 106th AES Convention, Munich, Germany.

Gan et al., "Virtual Bass for Home Entertainment, Multimedia PC, Game Station and Portable Audio Systems," IEEE Transactions on Consumer Electronics, Nov. 2001, vol. 47, No. 4, pp. 787-794.

Brown et al., "An Efficient HRTF Model for 3-D Sound," Proceedings of the IEEE ASSP Workshop on Applications of Signal Processing to Audio and Acoustics, 1997.

* cited by examiner

STEREO VIRTUAL BASS ENHANCEMENT

CROSS-REFERENCES TO RELATED APPLICATIONS

The present application claims benefit from U.S. provisional application No. 62/535,898 "STEREO VIRTUAL BASS ENHANCEMENT" filed on Jul. 23, 2017, which is incorporated hereby by reference in its entirety.

FIELD OF THE INVENTION

The present invention relates generally to psychoacoustic enhancement of bass sensation, and more particularly to preservation of directionality and stereo image under such enhancement.

BACKGROUND

Problems of psychoacoustic audio enhancement have been recognized in the conventional art and various techniques have been developed to provide solutions, for example:

1. U.S. Pat. No. 5,930,373 A, "Method and system for enhancing quality of sound signal".
2. Bai, Mingsian R., and Wan-Chi Lin. "Synthesis and implementation of virtual bass system with a phase-vocoder approach." Journal of the Audio Engineering Society 54.11 (2006): 1077-1091.
3. U.S. Pat. No. 6,134,330 "Ultra bass".
4. U. Zolzer, Ed., DAFX: Digital Audio Effects (Wiley, N.Y., 2002).
5. U.S. Pat. No. 8,098,835 B2, "Method and apparatus to enhance low frequency component of audio signal by calculating fundamental frequency of audio signal".
6. Blauert, Jens. Spatial hearing: the psychophysics of human sound localization. MIT press, 1997.
7. Sanjaume, Jordi Bonada. Audio Time-Scale Modification in the Context of Professional Audio Post-production. Informàtica i Comunicació digital, Universitat Pompeu Fabra Barcelona. Barcelona, Spain, 2002.

Psychoacoustic bass enhancement has received strong interest from consumer electronics manufacturers. Due to physical limitations and cost constraints, products such as low-end speakers and headphones often suffer from inferior bass performance.

Solutions have been proposed based on the psychoacoustic phenomenon known as the "missing fundamental", whereby the human auditory system can perceive the fundamental frequency of a complex signal according to its higher harmonics.

Many methods of bass enhancement exploit this effect, in essence creating a virtual pitch at low frequencies. It is thus common in the art of audio enhancement to add harmonics to an original signal, without producing the whole low frequency range, so that the audience can perceive the fundamental frequencies even though these frequencies not physically present in the generated sound or if the speakers/headphones cannot even generate the frequencies.

Some further examples for the psychoacoustic effect are shown in U.S. Pat. No. 5,930,373, in "Ben-Tzur, D. et al.: The Effect of MaxxBass Psychoacoustic Bass Enhancement on Loudspeaker Design, 106th AES Convention, Munich, Germany, 1999", in "Woon S. Gan, Sen. M. Kuo, Chee W. Toh: Virtual bass for home entertainment, multimedia pc, game station and portable audio systems, IEEE Transactions on Consumer Electronics, Vol. 47, No. 4, November 2001, page 787-794", at "http://www.srslabs.com/partners/aetech/trubass_theory.asp", at "http://vst-plugins.homemusician.net/instruments/virtual_bass_vb1.html", at "http://mp3.deepsound.net/plugins_dynamique.php", and at "http://www.srs-store.com/store-plugins/mall/pdfWOW%20XT%Plug-inmanual.pdf".

The references cited above teach background information that may be applicable to the presently disclosed subject matter. Therefore the full contents of these publications are incorporated by reference herein where appropriate for appropriate teachings of additional or alternative details, features and/or technical background.

General Description

Existing methods for virtual bass enhancement often replace the fundamental bass frequency with its higher harmonics. Such methods typically generate harmonics based on some type of monophonic signal, such as the sum of the stereo input audio channels. These harmonics are often controlled through a nonlinear gain control as shown in [1] or through an amplifier as shown in [3] and [5]. This gain adjustment is often intended to equalize the perceived loudness of the harmonics signal with the perceived loudness of the input fundamental frequency.

With non-monophonic input signals (e.g. stereo, binaural, surround etc.), these methods can suffer from problems, such as:

1. Corrupted stereo image—adding mono harmonics to the signal can cause the stereo image of those harmonics to shift towards the center. This panning can be highly significant in movies, for example, when the special effects are directional (or in motion or in live music content which contains some low frequency instruments in various positions.
2. Loss of perceived directionality in a binaural signal—it has been shown in literature that human ears are sensitive to directional cues such as—for example—Interaural Level Difference (ILD) and interaural Time Difference (ITD) even in low-frequencies. Hence adding mono harmonics to a binaural signal harms the perception of directionality, as the ILD and the ITD of the original content are not preserved.

These problems can become more severe in some consumer devices where the harmonics must be generated in higher frequencies due to the small size of the loudspeakers—as directional cues in higher frequencies are highly important for the stereo image in stereo audio, and for perceived directionality in a binaural signal.

Among the advantages of some embodiments of the presently disclosed subject matter are: providing a bass enhancement effect which can better preserve stereo image, can better preserve directional perception of binaural signals, and can better preserve directional cues including ILD and ITD.

According to one aspect of the presently disclosed subject matter there is provided a method for conveying to a listener a directionality-preserving pseudo low frequency psychoacoustic sensation of a multichannel sound signal, comprising:

deriving from the sound signal, by a processing unit, a high frequency multichannel signal and a low frequency multichannel signal, the low frequency multichannel signal extending over a low frequency range of interest;

generating, by the processing unit, a multichannel harmonic signal, the loudness of at least one channel signal of the multichannel harmonic signal substantially matching the loudness of a corresponding channel in the low frequency multichannel signal; and at least one interaural level difference (ILD) of at least one frequency of at least one channel pair of the multichannel harmonic signal substantially matching an ILD of a corresponding fundamental frequency in a corresponding channel pair in the low frequency multichannel signal; and summing, by the processing unit, the harmonic multichannel signal and the high frequency multichannel signal thereby giving rise to a psychoacoustic alternative signal.

In addition to the above features, the method according to this aspect of the presently disclosed subject matter can comprise one or more of features (i) to (ix) listed below, in any desired combination or permutation which is technically possible:

(i) the at least one channel signal comprises all channel signals of the multichannel harmonic signal.

(ii) the at least one interaural level difference comprises all interaural level differences of the at least one frequency.

(iii) the at least one, fundamental frequency comprises all channel signals of the low frequency multichannel signal.

(iv) the generating a harmonic multichannel signal comprises:

for at least two channel signals of the low frequency multichannel signal, generating per-channel harmonics signals, each comprising at least one harmonic frequency of a fundamental frequency of the channel signal;

deriving a reference signal according to the low frequency multichannel signal;

generating a loudness gain adjustment according to a loudness of the reference signal; and generating an ILD gain adjustment for each of the per-channel harmonics signals, according to, at least, a level difference between the at least one channel signal and the reference signal; and applying the generated loudness gain adjustment and respective ILD gain adjustment to each of the per-channel harmonics signals.

(v) the generating a harmonic multichannel signal comprises:

for at least two channel signals of the multichannel sound signal, generating per-channel harmonics signals, each comprising at least one harmonic frequency of a fundamental frequency of the channel signal;

deriving a reference signal according to the low frequency multichannel signal;

generating a gain adjustment according to a loudness of the reference signal and, at least, a level difference between the at least one channel signal and the reference signal; and applying the gain adjustment to each of the per-channel harmonics signals.

(vi) the generating a harmonic multichannel signal comprises:

for at least two channel signals of the low frequency multichannel signal, generating per-channel harmonic signals, each comprising at least one harmonic frequency of a fundamental frequency of the channel signal;

according to the per-channel harmonic signals, calculating a linked envelope, and applying a nonlinear gain curve to the linked envelope, resulting in a loudness gain adjustment;

for each of the per-channel harmonic signals, calculating an unlinked envelope, and applying a nonlinear gain curve to the unlinked envelope, resulting in an ILD gain adjustment; and for each of the per-channel harmonic signals, applying loudness gain adjustment and the respective ILD gain adjustment.

(vii) the generating a harmonic multichannel signal comprises:

for at least two channel signals of the low frequency multichannel signal, generating per-channel harmonic signals, each comprising at least one harmonic frequency of a fundamental frequency of the channel signal;

according to the per-channel harmonic signals, calculating a linked envelope, and applying a nonlinear gain curve to the linked envelope, resulting in a loudness and. ILD gain adjustment; and for each of the per-channel harmonic signals, applying the loudness and ILD gain adjustment.

(viii) the generating a harmonic multichannel signal comprises:

for at least two channel signals of the low frequency multichannel signal, generating per-channel harmonic signals, each comprising at least one harmonic frequency of at least one fundamental frequency of the low frequency channel signal, thereby resulting in at least two per-channel harmonic signals;

deriving a reference signal according to the low frequency multichannel signal;

for at least one frequency in each per-channel harmonic signal, generating a per-frequency loudness gain adjustment such that a loudness of the at least one frequency, adjusted according to the per-frequency loudness gain adjustment, substantially matches a loudness of a corresponding fundamental frequency of the reference signal;

for the at least one frequency of each per-channel harmonic signal, calculating a per-frequency ILD gain adjustment such that an ILD of the at least one frequency of each per-channel harmonic signal, adjusted according to the per-frequency ILD gain adjustment, substantially matches an ILD of the fundamental frequency of the low frequency channel signal corresponding to the ILD of the fundamental frequency in the reference low frequency signal; and applying the loudness gain adjustment and respective ILD gain adjustments to the at least one frequency of each of the per-channel harmonic signals.

(ix) the generating per-channel harmonic signals synchronizes the phase of the harmonic signals with the phase of the low-frequency multichannel signal.

According to another aspect of the presently disclosed subject matter there is provided a system comprising a processing unit, wherein the processing unit is configured to operate in accordance with claim 1.

According to another aspect of the presently disclosed subject matter there is provided a non-transitory program storage device readable by a processing circuitry, tangibly embodying computer readable instructions executable by the processing circuitry to perform a method for conveying to a listener a directionality-preserving pseudo low frequency psycho-acoustic sensation of a multichannel sound signal, comprising:

deriving from the sound signal, by a processing unit, a high frequency multichannel signal and a low frequency multichannel signal, the low frequency multichannel signal extending over a low frequency range of interest;

generating, by the processing unit, a multichannel harmonic signal, the loudness of at least one channel signal of the multichannel harmonic signal substantially matching the loudness of a corresponding channel in the low frequency multichannel signal; and at least one interaural level difference (ILD) of at least one frequency of the at least one channel pair of the multichannel harmonic signal substantially matching an ILD of a corresponding fundamental frequency in a corresponding channel pair in the low frequency multichannel signal; and summing, by the processing unit, the harmonic multichannel signal and the high frequency multichannel signal thereby giving rise to a psychoacoustic alternative signal.

BRIEF DESCRIPTION OF THE DRAWINGS

In order to understand the invention and to see how it can be carried out in practice, embodiments will be described, by way of non-limiting examples, with reference to the accompanying drawings, in which.

DETAILED DESCRIPTION

Figure 1:
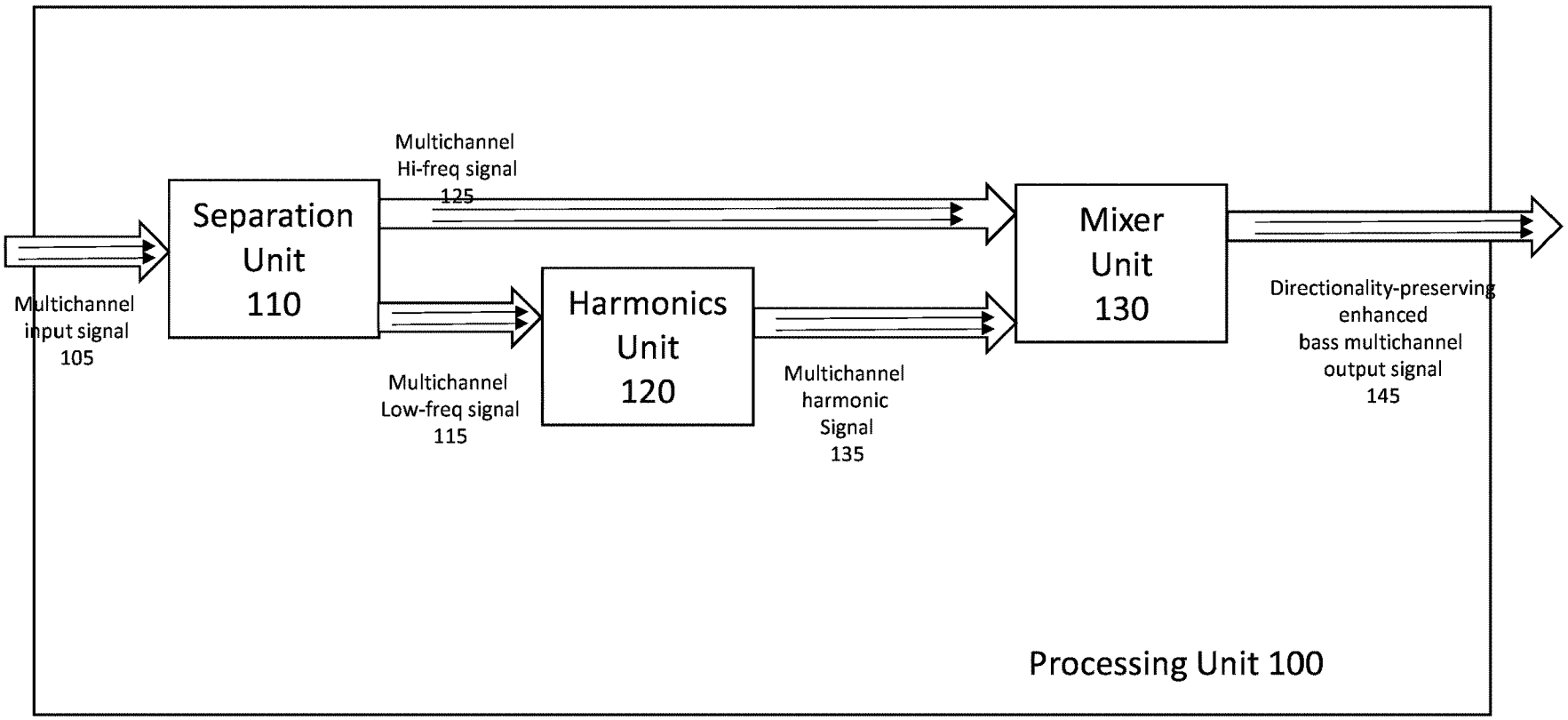
FIG. 1 is a schematic diagram of general system of virtual bass enhancement, in accordance with some embodiments of the presently disclosed subject matter.

In the following detailed description, numerous specific details are set forth in order to provide a thorough understanding of the invention. However, it will be understood by those skilled in the art that the presently disclosed subject matter may be practiced without these specific details. In other instances, well-known methods, procedures, components and circuits have not been described in detail so as not to obscure the presently disclosed subject matter.

Unless specifically stated otherwise, as apparent from the following discussions, it is appreciated that throughout the specification discussions utilizing terms such as "processing", "computing", "representing", "comparing", "generating", "assessing", "matching", "updating" or the like, refer to the action(s) and/or process(es) of a computer that manipulate and/or transform data into other data, said data represented as physical, such as electronic, quantities and/or said data representing the physical objects. The term "computer" should be expansively construed to cover any kind of hardware-based electronic device with data processing capabilities including, by way of non-limiting example, "processing unit" disclosed in the present application.

The terms "non-transitory memory" and "non-transitory storage medium" used herein should be expansively construed to cover any volatile or non-volatile computer memory suitable to the presently disclosed subject matter.

The operations in accordance with the teachings herein may be performed by a computer specially constructed for the desired purposes or by a general-purpose computer specially configured for the desired purpose by a computer program stored in a non-transitory computer-readable storage medium.

Embodiments of the presently disclosed subject matter are not described with reference to any particular programming language. It will be appreciated that a variety of programming languages may be used to implement the teachings of the presently disclosed subject matter as described herein.

Human perception of direction of sound is based mainly on directional cues such as ILD (inter-aural level difference) and ITD (inter-aural time difference). A multi-channel audio content to be reproduced is assumed to include ILD and ITD cues resulting from the recording or mixing process. For example: stereo music contains several instruments and vocals, each positioned in a different direction in the stereo image, encoded by a stereophonic microphone used for recording, or by amplitude panning in the multi-track mixing process.

When a subject is listening to loudspeakers, due to the cross-talk from each loudspeaker to the opposite ear, the perceived ITD of a sound source is in fact affected by both the time (or phase) and level differences between the channels of the signal.

However, when monophonic bass harmonics have been added to the signal, the perceived ILD of the fundamental frequency in the original sound (as indicated by the ratio between the level of the fundamental frequency in the left channel to the level of the fundamental frequency in right channel) is not preserved in the harmonics for both headphones and loudspeakers listening setups. By the mono summing of the channels before the harmonics generation, ITD is also not preserved. When the same content is reproduced over limited-range loudspeakers or headphones, lacking bass response, and when some of the bass energy is replaced with higher harmonics for bass-enhancement (e.g. [1]), it is desirable to preserve the directional cues as they would be reproduced by a full-range device.

Figure 7:
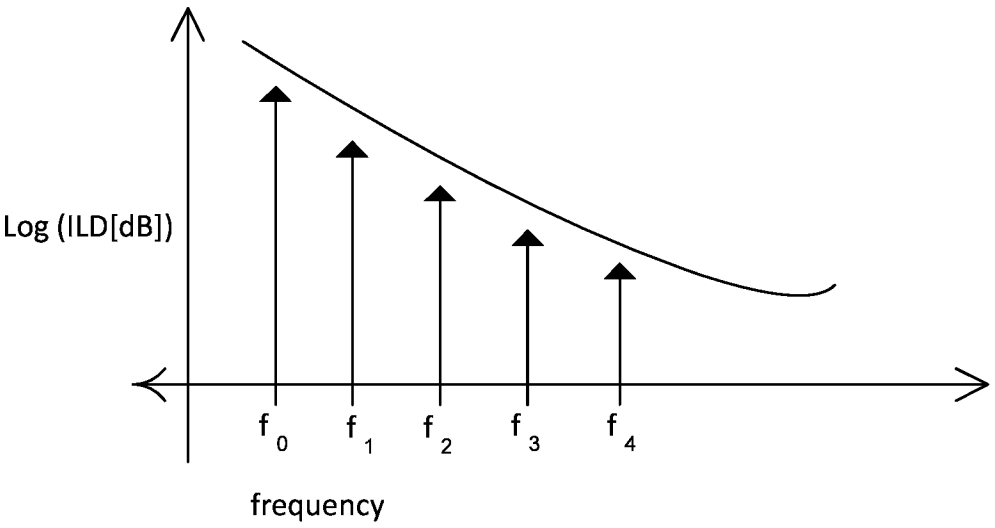
FIG. 7 illustrates an exemplary curve of a head shadowing model, in accordance with some embodiments of the presently disclosed subject matter.

In order to produce harmonics signal in multi channels system which preserve the stereo image and the ILD of binaural content we should take into consideration the following:

a) The compensation for the loudness as described in ref [1] should be the same for all channels in order to maintain the stereo image. For example, in the particular case of generation harmonics using a feedback loop [1], contain a multiplication which expands the harmonics signal, the compensation for this expansion (using a compressor for example), should be linked i.e. the same compensation gain for all channels.

b) The ILD is monotonically decreasing as function of frequency according to head shadowing model as shown in FIG. 7, which means that the intensity of the $1^{st}$ harmonics should be lower than the intensity of the fundamental, and in general each harmonic should be stronger (or equal in case of zero degree in which the ILD is 0 dB for all frequencies) than the next one. In addition, in low frequencies (below 1 KHz) the ratio between the ILD in the fundamental to $1^{st}$ harmonics is constant in log [dB] scale for all angles. This is true also for the higher harmonics: the ratio in log scale between the ILD in the Nth harmonics to ILD in the (N+1)th harmonics is constant no matter what was the angle of the source. In order to substantially preserve the directionality, we should generate the harmonics with consideration of the ILD decreasing curve. Because the decreasing is linear in all angles log [dB] scale), it can be generated only by expansion (i.e. $y=x^a$) of the input signal for each harmonic by a=N*r (in relation to the fundamental), while N is the Nth harmonics and r is a constant (experimentally found to be ~3.9) which express the ratio between the ILD[dB] in the fundamental to ILD[dB] in the $1^{st}$ harmonics. In the particular case of generation harmonics using a feedback loop which contains a multiplication expanding the harmonics signal, the compensation will take into consideration also the inherent expansion of the feedback loop ($y=x^2$->r=3.9−2=1.9)

In the descriptions provided hereinbelow, operations are sometimes described, for reasons of convenience, as being applied to all channels, to all frequencies in a channel, to all ILDs etc. It will be understood that in all these cases that, by way of non-limiting example, these operations can be applied to a subset of the channels, frequencies in a channel etc. in some embodiments of the presently disclosed subject matter.

Similarly, in the descriptions provided hereinbelow, operations are sometimes described, for reasons of convenience, using identifiers such as, for example, 390, It will be understood that such descriptions can also pertain, by way of non-limiting example, to identifiers 390*a,* 390*b* etc.

Attention is now directed to FIG. 1, which illustrates an exemplary system for directionality-preserving bass enhancement of a multichannel signal, according to some embodiments of the presently disclosed subject matter.

Processing Unit 100 is an exemplary system which implements directionality-preserving bass enhancement. Processing Unit 100 can receive a multichannel input signal 105, which can contain various types of audio content such as, by way of non-limiting example, high fidelity stereophonic audio, binaural or surround-sound game content, etc. Processing Unit 100 can output a loudness-preserving and directionality-preserving enhanced bass multichannel output signal 145, which is, for example, suited for output on a restricted-range sound output device such as earphones or a desktop speaker.

Processing unit 100 can be, for example, a signal processing unit based on analog circuitry. Processing unit 100 can, for example, utilize digital signal processing techniques (for example: instead of or in addition to analog circuitry). In this case processing unit 100 can include a DSP (or other type of CPU) and memory. An input audio signal can then be, for example, converted to a digital signal using techniques well-known in the art, and a resulting digital output signal can, for example, similarly be converted to an analog audio signal for further analog processing. in this case the various units shown in FIG. 1 are referred to as "comprised in the processing unit".

Processing unit 100 can include separation unit 110. Separation unit 110 can separate the low frequencies over a given range of interest from multichannel input signal 105, resulting in multichannel low-frequency signal 115 and multichannel high-frequency signal 125. Separation unit 110 can be implemented by, for example, directing each channel of multichannel input signal 105 through a high-pass filter (HPF) and a low-pass filter (LPF) (arranged in parallel), and passing the HPF output to multichannel hi-frequency signal 125, and the LPF output to multichannel low-frequency signal 115.

Processing unit 100 can include harmonics unit 120. Harmonics unit 120 can generate—for each channel in the multichannel signal—harmonic frequencies according to the fundamental frequencies present in multichannel low-frequency signal 115, and output multichannel harmonic signal 135.

In some embodiments of the presently disclosed subject matter, harmonics unit 120 produces multichannel harmonic signal 135 with some or all of the following characteristics:

a) the loudness of at least one channel signal of the multichannel harmonic signal substantially matches the loudness of a corresponding channel in the low frequency multichannel signal b) at least one interaural level difference (ILD) of at least one frequency of the at least one pair of channels of the multichannel harmonic signal substantially matches an ILD of a corresponding fundamental frequency in a corresponding pair of channels in the low frequency multichannel signal The loudness of one signal can be considered as substantially matching the loudness of another signal when, for example, the criteria for "essentially loudness match" specified in [1] are met. A fundamental frequency from which a harmonic is derived is herein referred to as a corresponding fundamental frequency. A channel in the low-frequency multichannel signal from which a channel in the harmonic multichannel signal is derived is herein referred to as a corresponding channel.

The ILD of one pair of channels of a multichannel signal at a particular frequency can be considered as substantially matching the ILD of another pair of channels in the corresponding multichannel signal at a different frequency when, for example, the ILDs have equivalent perceived level difference according to, for example, a frequency-sensitive head-shadowing model such as, for example, the model described in Brown, C. P., Duda, R. O.: An efficient hrtf model for 3-D sound. In: Proceedings of the IEEE ASSP Workshop on Applications of Signal Processing to Audio and Acoustics, IEEE (1997).

Harmonics unit 120 can be implemented in any suitable manner. By way of non-limiting example, harmonics unit 120 can be implemented using a time-domain structure as described herein below with reference to FIG. 3. By way of non-limiting example, harmonics unit 120 can be implemented using a frequency-domain structure as described herein below with reference to FIG. 5.

Processing unit 100 can include mixer unit 130. Mixer unit 130 can combine multichannel high-frequency signal 125 and multichannel harmonic signal 135 to create output multichannel harmonic signal 135. Mixer unit 130 can be implemented, for example, by a mixer circuit or by its digital equivalent.

It is noted that the teachings of the presently disclosed subject matter are not bound by the directionality-preserving bass enhancement system described with reference to FIG. 1. Equivalent and/or modified functionality can be consolidated or divided in another manner and can be implemented in any appropriate combination of software with firmware and/or hardware and executed on a suitable device. The processing unit (100) can be a standalone entity, or integrated, fully or partly, with other entities.

Figure 2:
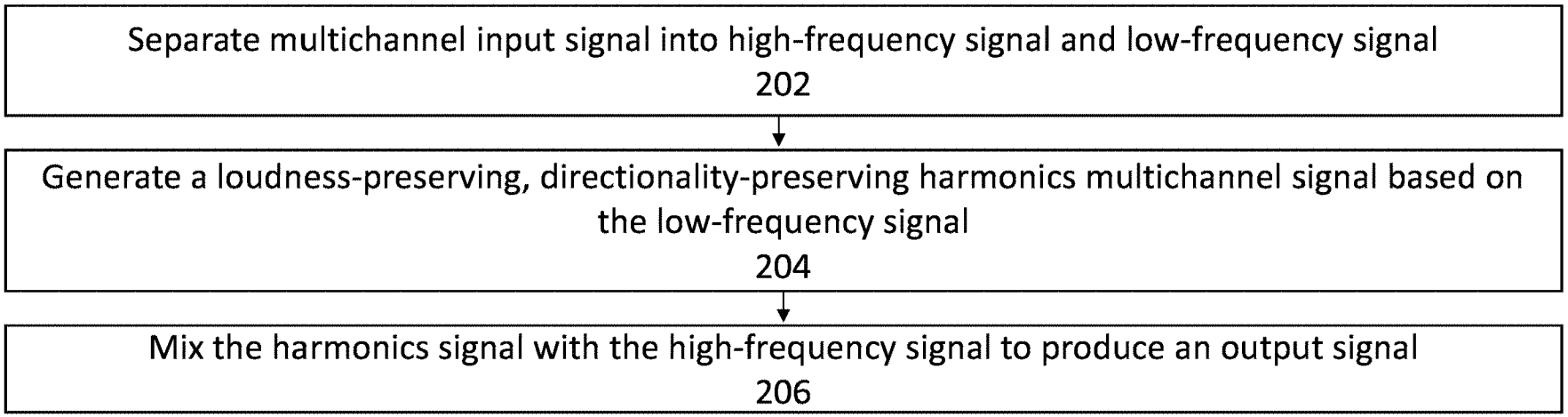
FIG. 2 illustrates a generalized flow diagram for an exemplary method of directionality-preserving bass enhancement, in accordance with some embodiments of the presently disclosed subject matter.

FIG. 2 illustrates a generalized flow diagram for an exemplary method of directionality-preserving bass enhancement based on the structure of FIG. 1 in accordance with some embodiments of the presently disclosed subject matter.

It is noted that the teachings of the presently disclosed subject matter are not bound by the flow chart illustrated in FIG. 2, the illustrated operations can occur out of the illustrated order. It is also noted that whilst the flow chart is described with reference to elements of the system of FIG. 1, this is by no means binding, and the operations can be performed by elements other than those described herein.

Figure 2A:
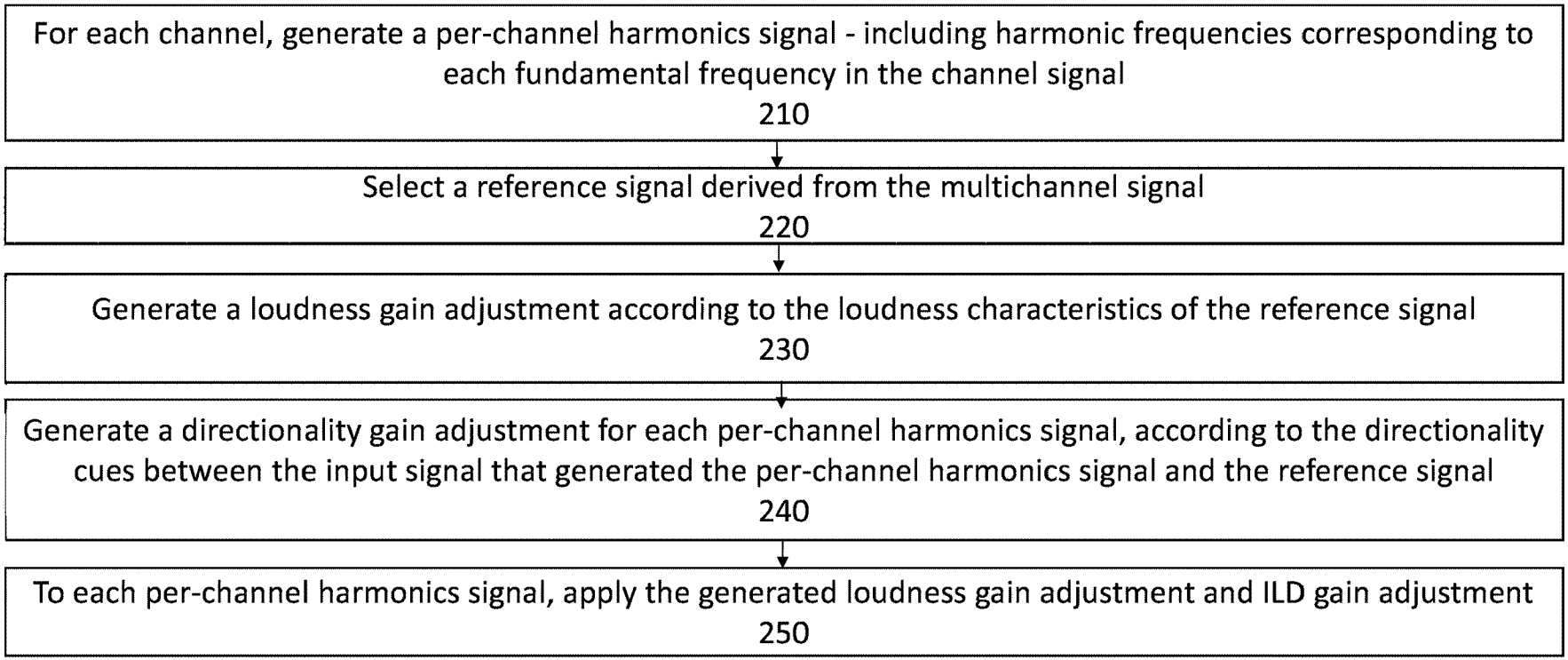
FIG. 2*a* illustrates a generalized flow diagram for an exemplary method of generation of a directionality-preserving harmonics signal, in accordance with some embodiments of the presently disclosed subject matter.

Attention is now directed to FIG. 2*a,* which illustrates an exemplary method for generation of a directionality-preserving harmonics signal, according to some embodiments of the presently disclosed subject matter.

The processor 100 (for example: harmonics unit 120) can, for each channel, generate 210 a per-channel harmonics signal—including harmonic frequencies corresponding to each fundamental frequency in the channel signal.

The processor 100 (for example: harmonics unit 120) can generate 220 a reference signal derived from the multichannel signal (for example: for every sample in the time domain or for every buffer in the frequency domain).

The processor 100 (for example: harmonics unit 120) can generate 230 a loudness gain adjustment according to the loudness characteristics of the reference signal2

The processor 100 (for example: harmonics unit 120) can generate 240 a directionality gain adjustment for each per-channel harmonics signal, according to the directionality cues between the input signal that generated the per-channel harmonics signal and the reference signal The processor 100 (for example: harmonics unit 120) can, to each per-channel harmonics signal, apply 250 the generated loudness gain adjustment and ILD gain adjustment.

It is noted that the teachings of the presently disclosed subject matter are not bound by the flow chart illustrated in FIG. 2*a,* the illustrated operations can occur out of the illustrated order. It is also noted that whilst the flow chart is described with reference to elements of the system of FIG. 1, this is by no means binding, and the operations can be performed by elements other than those described herein.

Figure 3:
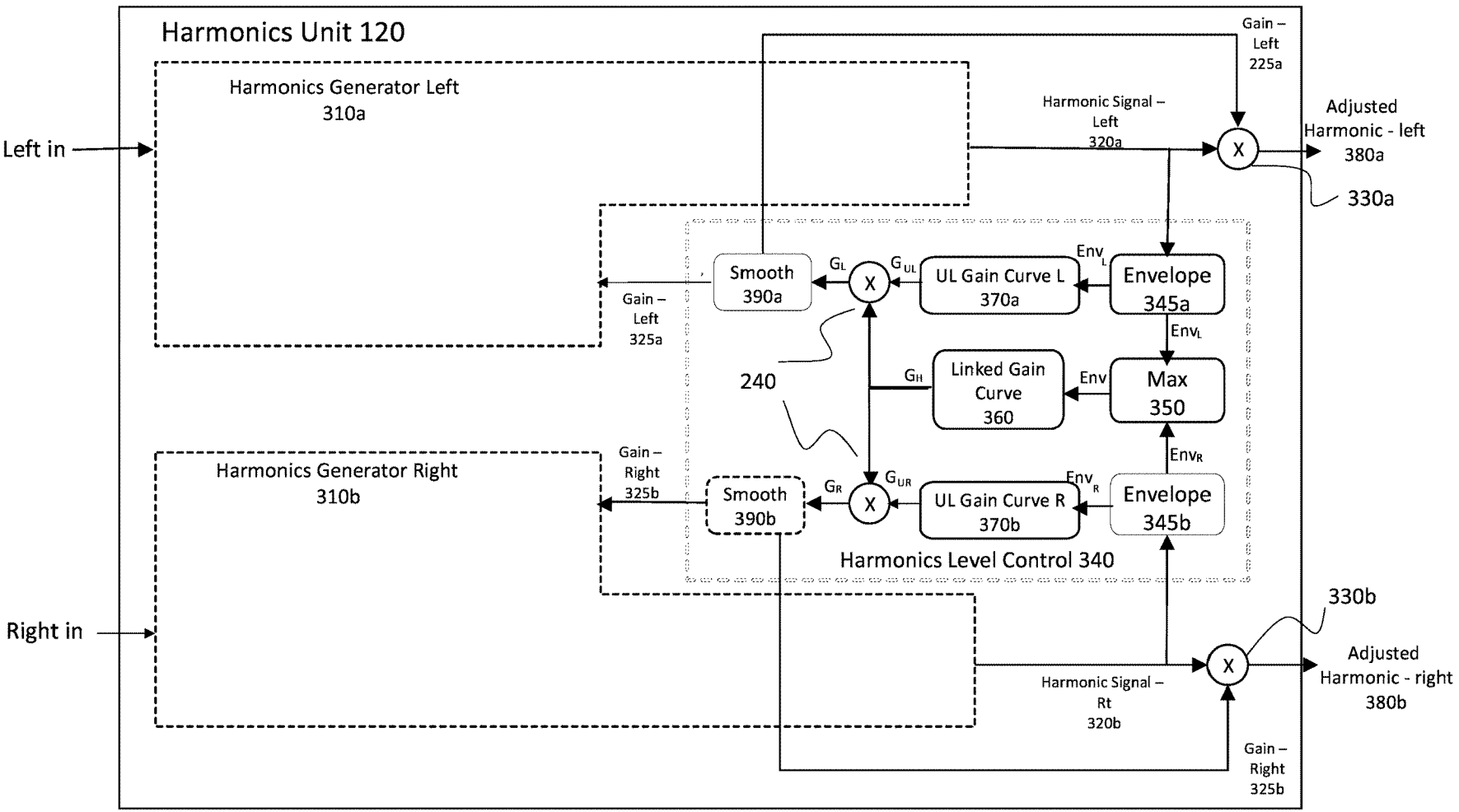
FIG. 3 illustrates an exemplary time-domain-based structure of a harmonics unit, in accordance with some embodiments of the presently disclosed subject matter.

Attention is now directed to FIG. 3, which illustrates an exemplary time-domain-based structure of a harmonics unit, according to some embodiments of the presently disclosed subject matter.

For clarity of explanation, exemplary harmonics unit 120 includes processing for two audio channels. It will be clear to one skilled in the art how this teaching is to be applied in embodiments including more than two audio channels.

As described hereinabove with reference to FIG. 1, a multichannel input signal comprising the low frequencies of each channel can be received at the harmonics unit 120. The harmonics unit 120 can include a number of instances of a Harmonics Generator Unit (HGU) 310—for example one HGU 310 instance per channel of the multichannel signal. Each HGU instance can then process one low-frequency channel signal of the original low-frequency multichannel signal.

In some embodiments of the presently disclosed subject matter, the HGU 310*a* generates, according to its input signal, a harmonics signal 320*a* consisting of at least the first two harmonic frequencies of each fundamental frequency of the input signal.

Figure 8:
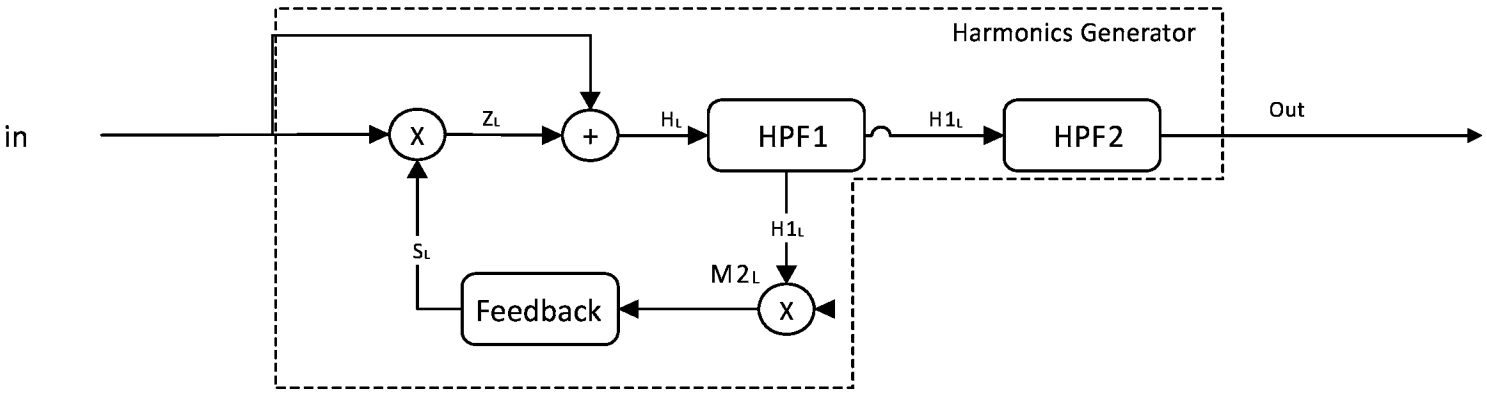
FIG. 8 illustrates an exemplary structure of a harmonics generation recursive feedback loop in accordance with some embodiments of the presently disclosed subject matter.

A HGU 310 can be implemented. for example, as a recursive feedback loop such as the one described in FIG. 4 of [1] (shown in FIG. 8 hereinbelow). The HGU 310*a* can also receive the Gain 325*a* as generated by the Harmonics Level Control Unit 340 described hereinbelow. The Gain 325*a* can function as a control signal which determines the intensity of the harmonics signal creation in the feedback loop.

In some embodiments of the presently disclosed subject matter, each harmonics signal 320*a,* 320*b* is utilized as an input to the Harmonics Level Control unit (HLC) 340. The HLC can output, for example, adjusted harmonics signals 380*a* 380*b,* where the adjusted harmonics signals substantially match both a) the loudness of the corresponding original low frequency channel signals and b) directional cue information such as, for example, the ILD or the ITD.

In some embodiments of the presently disclosed subject matter, the HLC 340 includes envelope components 345*a,* 345*b* which can determine an envelope for each per-channel harmonic signal. The per-channel envelope can then serve as input to a maximum selection component 350 and also to unlinked gain curve components 370*a* 370*b*.

Maximum selection component 350 receives each per-channel envelope as input, and outputs an envelope that is indicative of the loudness of the input channels. in some embodiments of the presently disclosed subject matter, the output envelope can be, for example, the maximum value of the input envelopes. In some embodiments of the presently disclosed subject matter, the output envelope can be, for example, the average value of the input envelopes. The output envelope can be supplied as input to the linked min curve component 360.

The linked gain curve component 360 can yield a gain curve that adjusts the loudness of the corresponding harmonics signal according to a loudness model such as Fletcher-Munson model—so that the loudness (for example as measured in phon) of each generated harmonic frequency is the same as the loudness of the fundamental frequency from which the harmonic was generated.

Figure 4:
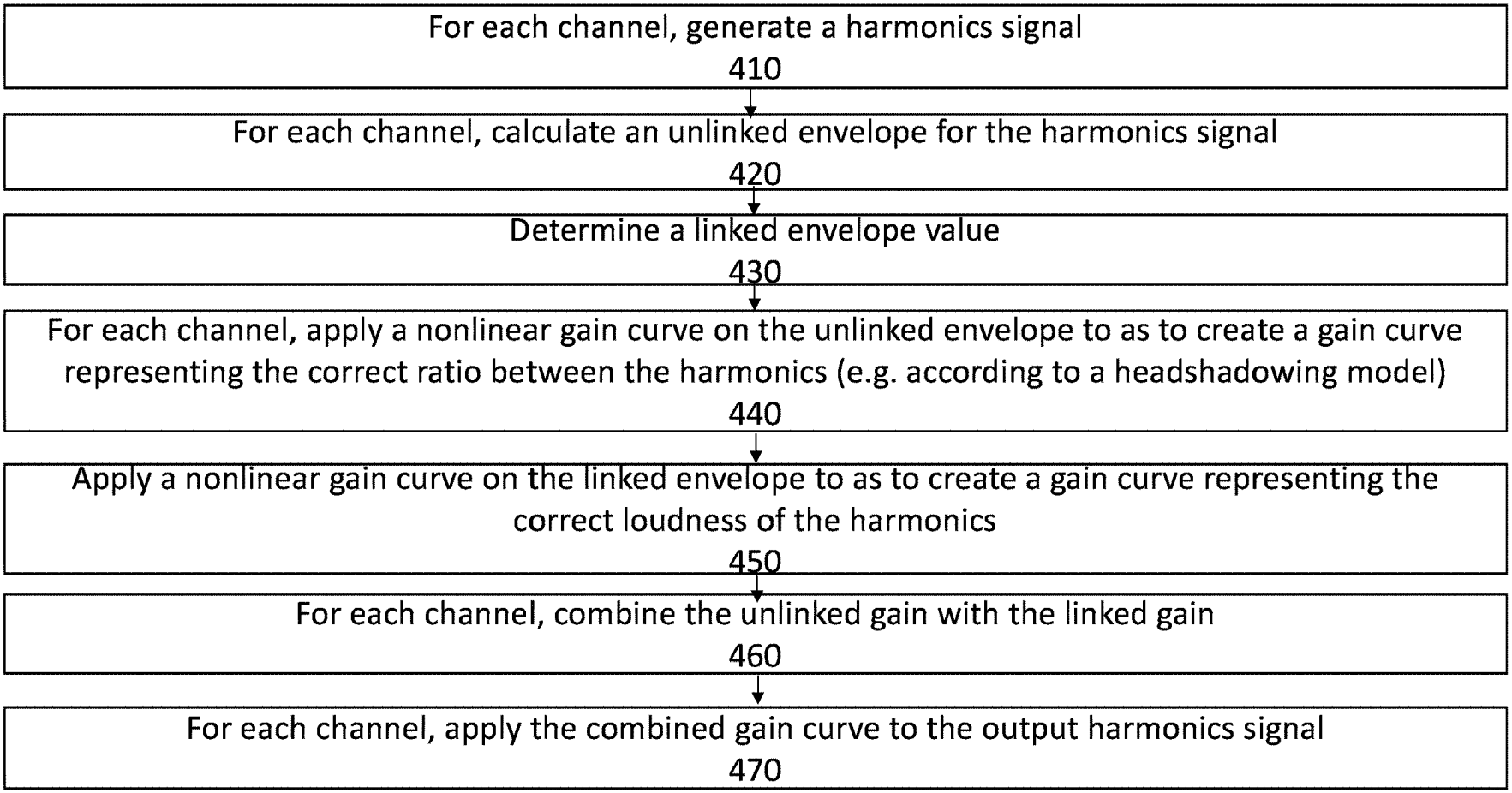
FIG. 4 illustrates a generalized flow diagram for exemplary time domain-based processing in harmonics unit 120, in accordance with some embodiments of the presently disclosed subject matter.
Figure 6:
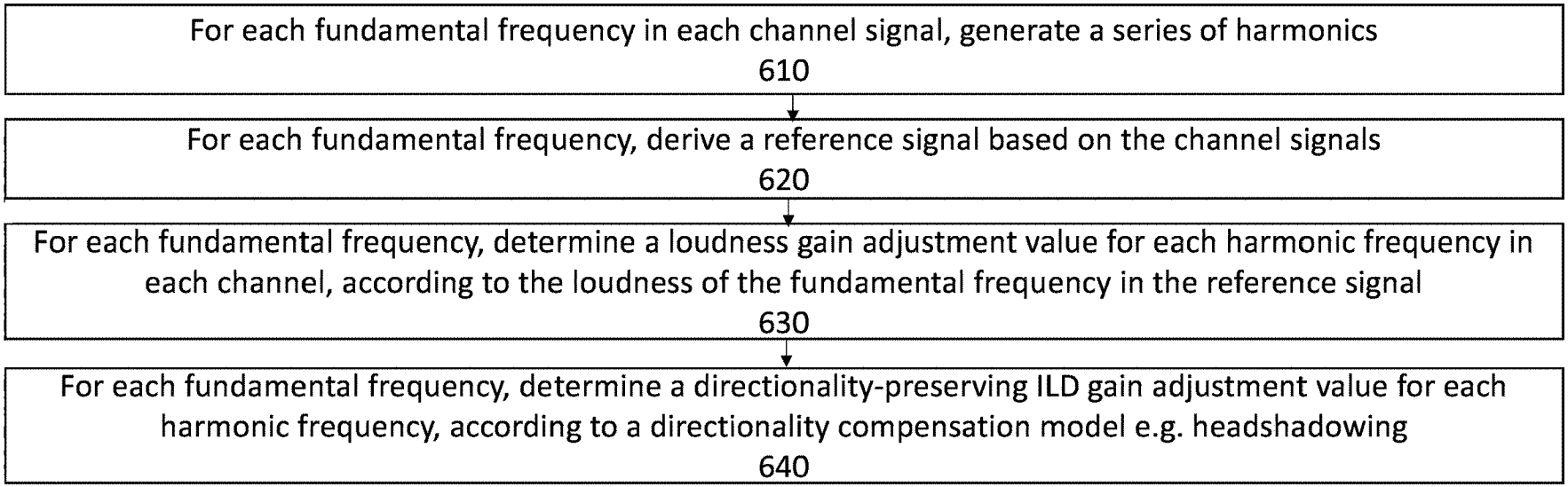
FIG. 6 illustrates a generalized flow diagram for exemplary frequency domain-based processing in harmonics unit 120, in accordance with some embodiments of the presently disclosed subject matter.

Linked gain curve component 360 can be implemented, for example, as a dynamic range compressor or an AGC as shown in FIG. 4 and. FIG. 6 of [1].

The nonlinear unlinked gain curve components 370*a* 370*b* can utilize envelope resulting from the maximum selection component 350 to yield a gain curve that adjusts the level of the corresponding harmonics signal according so that the perceived ILD of the harmonics signal substantially matches the ILD of the fundamental frequency.

Unlinked gain curve components 370*a* 370*b* can be implemented, for example, as a dynamic range compressor or an AGC as shown in FIG. 4 and FIG. 6 of [1].

The linked gains can then be multiplied by the unlinked gains, and the resulting gain signal is applied to both the harmonic signal 320 and as a control signal to the feedback process of the harmonic generator 310.

It is noted that the teachings of the presently disclosed subject matter are not bound by the directionality-preserving bass enhancement system described with reference to FIG. 3. Equivalent and/or modified functionality can be consolidated or divided in another manner and can be implemented in any appropriate combination of software with firmware and/or hardware and executed on a suitable device. The harmonics unit (120) can be a standalone entity, or integrated, fully or partly, with other entities.

Figure 3A:
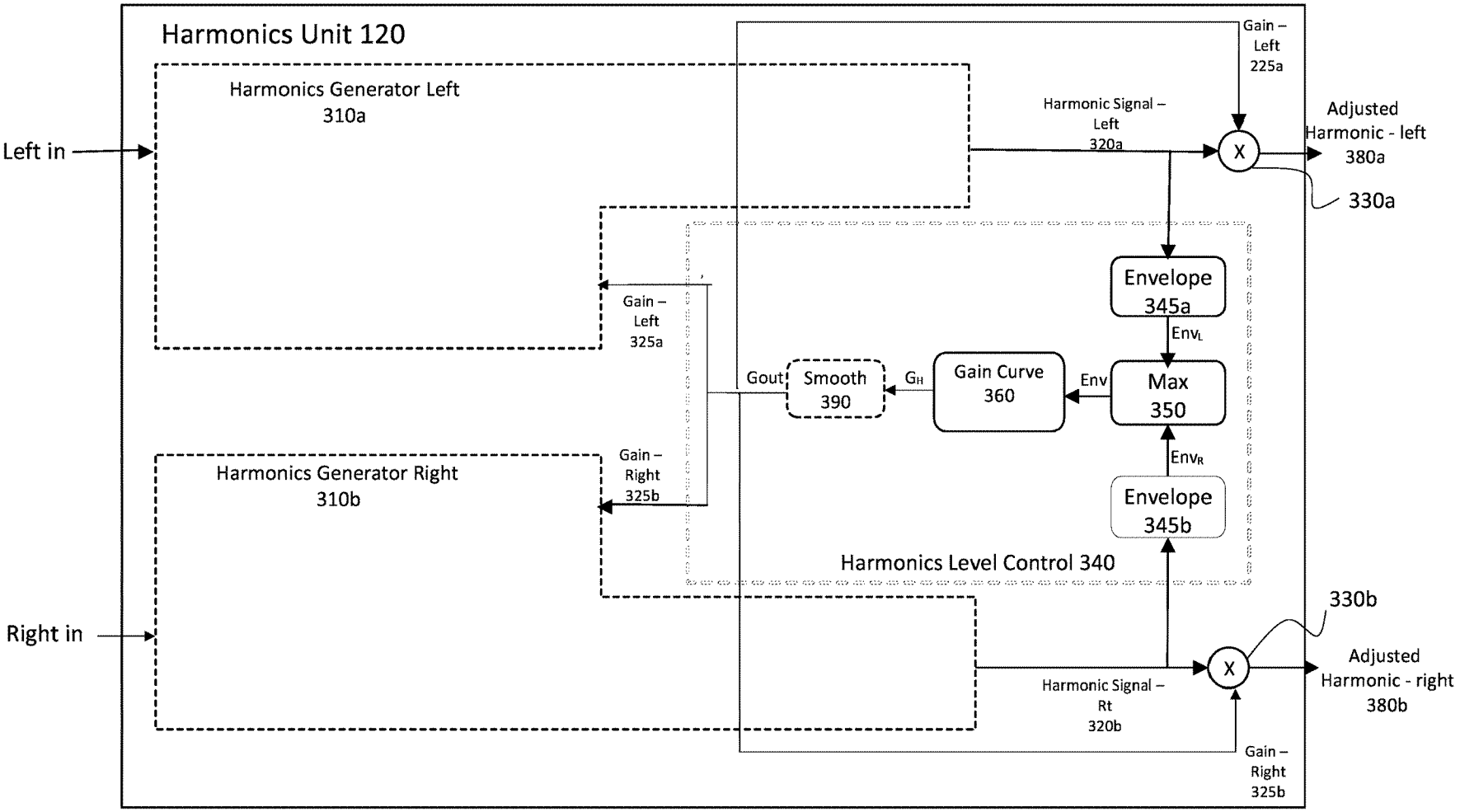
FIG. 3*a* illustrates a simplified version of the time-domain structure of a harmonics unit, in accordance with some embodiments of the presently disclosed subject matter

FIG. 3*a* represents a simplified version of the time-domain processing structure shown in FIG. 3. In this embodiment, there are no unlinked gain curve components. The single gain curve component 360 generates the control signal to the left and right harmonics generators 310*a* 310*b* is applied to both the harmonic signal 320*a* 320*b*. Gain curve component 360 can be eimplemented in different ways, such as, for example as a dynamic range compressor or an AGC as shown in FIG. 4 and FIG. 6 of [1].

It is noted that the teachings of the presently disclosed subject matter are not bound by the directionality-preserving bass enhancement system described with reference to FIG. 3*a*. Equivalent and/or modified functionality can be consolidated or divided in another manner and can be implemented in any appropriate combination of software with firmware and/or hardware and executed on a suitable device. The harmonics unit (120) can be a standalone entity, or integrated, fully or partly, with other entities.

Attention is now drawn to FIG. 4, which illustrates a generalized flow diagram for exemplary time domain-based processing in harmonics unit 120, according to some embodiments of the presently disclosed subject matter.

The processing unit (100) (for example: harmonics generator units 310) can, for each channel, generate 410, according to its input signal, a harmonics signal 320*a* consisting of at least the first two harmonic frequencies of each fundamental frequency of the input signal.

The processing unit (100) (for example: envelope units 345) can, for each channel, calculate 420 an envelope for the harmonics signal.

The processing unit (100) (for example: maximum unit 350) can determine 430 a linked envelope value.

The processing unit (100) (for example: unlinked gain curve 345) can, for each channel, apply 440 a nonlinear gain curve on the unlinked envelope to as to create a gain curve representing the correct ratio between the harmonics (e.g. according to a head shadowing model).

The processing unit (100) (for example: linked gain curve 360) can apply 450 a nonlinear gain curve on the linked envelope to as to create a gain curve representing the correct loudness of the harmonics.

The processing unit (100) (for example: mixer 240) can, for each channel, combine 460 the unlinked gain with the linked gain.

The processing unit (100) (for example: mixer 330) can, for each channel, apply 470 the combined gain curve to the output harmonics signal.

It is noted that the teachings of the presently disclosed subject matter are not bound by the flow chart illustrated in FIG. 4, the illustrated operations can occur out of the illustrated order. It is also noted that whilst the flow chart is described with reference to elements of the system of FIG. 3 or 3*a*, this is by no means binding, and the operations can be performed by elements other than those described herein.

Figure 5:
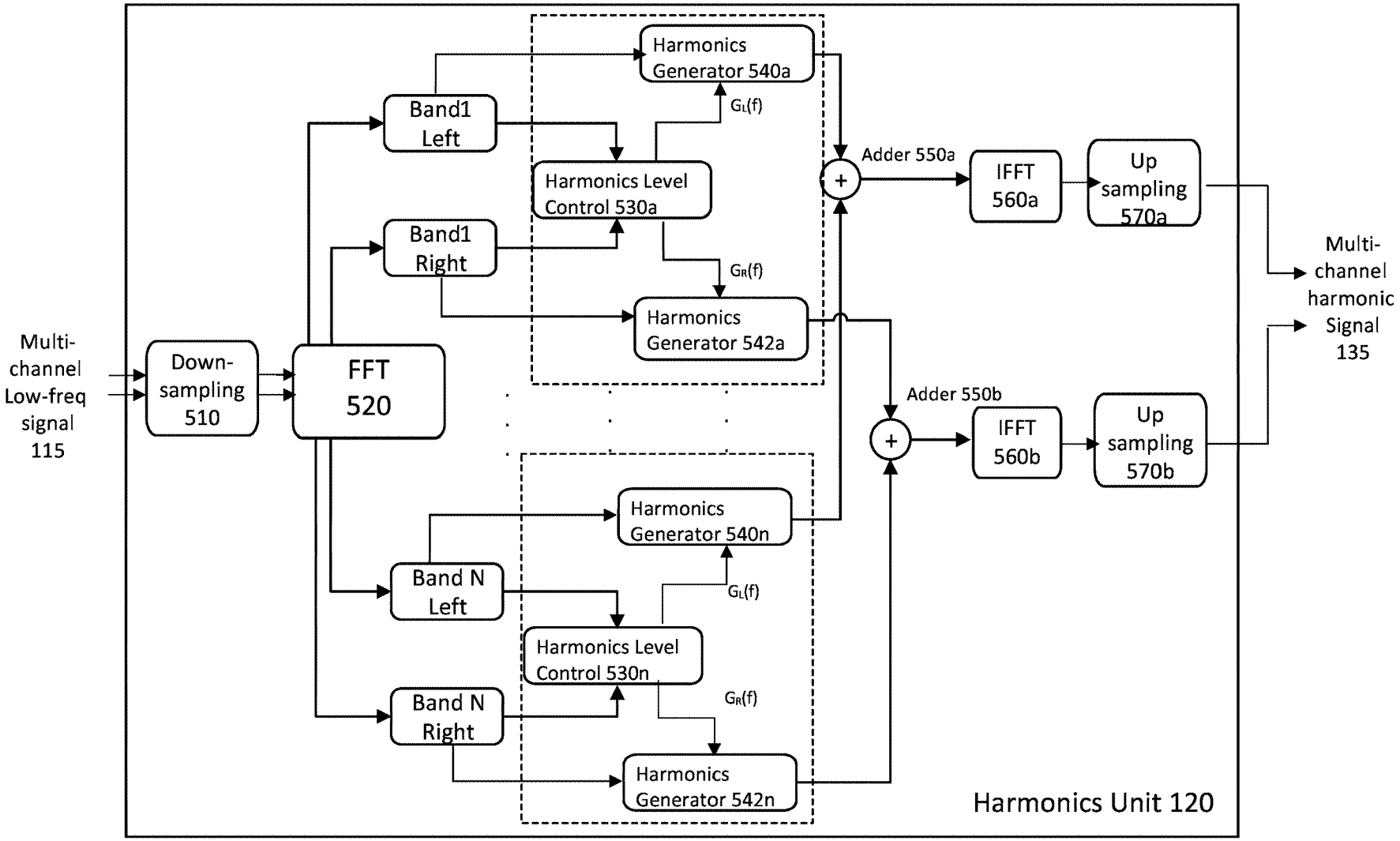
FIG. 5 illustrates an exemplary frequency-domain-based structure of a harmonics unit, in accordance with some embodiments of the presently disclosed subject matter.

Attention is now directed to FIG. 5, which illustrates an exemplary frequency-domain-based structure of a harmonics unit, according to some embodiments of the presently disclosed subject matter.

For clarity of explanation, exemplary harmonics unit 120 includes processing for two audio channels. It will be clear to one skilled in the art how this teaching is to be applied in embodiments including more than two audio channels.

Harmonics unit 120 can optionally include a downsampling component 510. Downsampling component 510 can reduce the original sampling rate by a factor (termed D) so that the highest harmonic frequency will be below the Nyquist frequency of the new sample rate (2*sample_rate/D). By way of non-limiting example, if the highest harmonic frequency is 1400 Hz (the 4th harmonic)) and the sample_rate is 48 KHz then D will be 16.

Harmonics unit 120 can include, for example, a Fast Fourier Transform (FFT) component 520. The FFT can convert the input time domain signal to a frequency domain signal. In some embodiments of the presently disclosed subject matter, a different time-domain to frequency-domain conversion method can be used instead of FFT. The FFT can be used, for example, with or without time overlap and/or by summing the bands of a filter-bank.

FFT 520 can, for example, split the frequency domain signal into a group of frequency bands—where each band contains a single fundamental frequency. Each band can further consist of several bins.

Harmonics unit 120 can include—for each band—a Harmonics Level Control component 530 and a pair of harmonics generator components 540, 542 (one per channel). Harmonics Level Control component 530 and harmonics generator components 540, 542 can, for example, receive the per-band multichannel input signal as input.

where "fund" is the linear sound pressure level in the fundamental bin and hN is the linear sound pressure level in the Nth harmonics bin of the relevant fundamental.

Per-band harmonics generators 540, 542 can generate—for each channel of the multichannel signal—a series of harmonics signals (up to Nyquist frequency) with intensity equal to the fundamental frequency intensity. Per-band harmonics generators 540, 542 can generate the harmonics signals using methods known in the art, such as, for example, by applying a pitch shift of the fundamental as described in [2].

Per-band harmonics level control 530 can select, in each band—a channel with the highest fundamental frequency signal intensity (hereforward termed channel iMax).

It is noted that at this stage the level of the harmonics is equal to the level of the fundamental.

Per-band harmonics level control 530 can calculate for each bin in the band for each channel, the LC (loudness compensation) i.e. a gain value to render the loudness of harmonic frequencies of the bin as, for example, substantially matching the loudness of the fundamental frequency of the band in channel iMax. The loudness value can be determined, for example, using a Sound Pressure Level-to-phony ratio based on Fletcher-Munson equal loudness contours.

Optionally, per-band harmonics level control 530 can smooth the loudness compensation gains over time.

Per-band harmonics level control 530 can measure—for each channel and for each band in the channel—an ILD of the fundamental. It can do this, for example, by calculating the ratio between the level of the fundamental frequency in this channel in the input signal and level of the fundamental frequency in channel iMax.

By way of non-limiting example, continuing with the signal described above, the ILD of the fundamental is 0.5/1 i.e. 0.5.

Per-band harmonics level control 530 can calculate—for each channel—for each bin in the band, an ILD compensation gain i.e. a gain value to render the perceived ILD of harmonic frequencies of the bin (relative to channel iMax) as, for example, substantially matching the calculated ILD for the channel (relative to channel iMax).

Perceived ILD can be assessed according to, for example, a head shadowing model such as the exemplary curve shown in FIG. 7. More specifically, the head-shadowing model described in Brown, C. P., Duda, R. O.: An efficient hrtf model for 3-D sound. In: Proceedings of the IEEE ASSP Workshop on Applications of Signal Processing to Audio and Acoustics, IEEE (1997) can, for example, be employed.

Per-band harmonics level control 530 can derive directionality-preserving compensation gains by, for example, multiplying the calculated ILD of the fundamental by the calculated ILD compensation gains.

Optionally, per-hand harmonics level control 530 can smooth the directionality-preserving compensation gains over time.

Figure 5A:
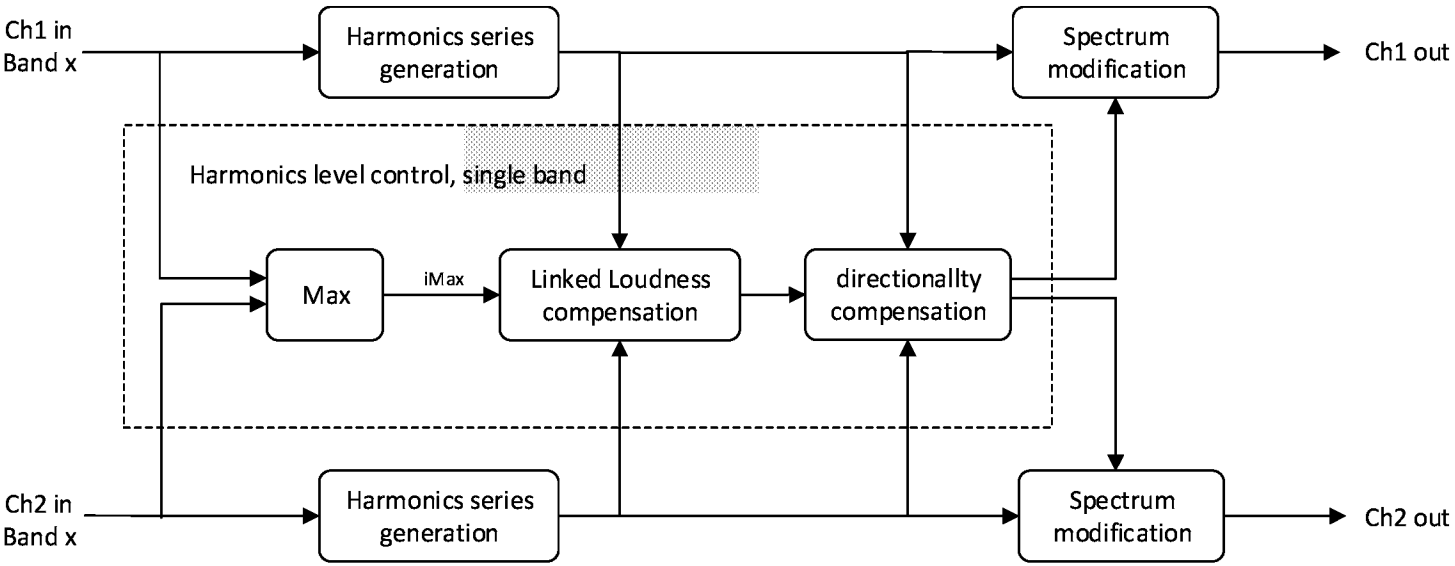
FIG. 5*a* illustrates an exemplary spectrum modification component of a frequency-domain-based structure of a harmonics unit, in accordance with some embodiments of the presently disclosed subject matter.

Per-band harmonics level control 530 can—for each channel and for each hand within the channel—apply a spectrum modification for the harmonics signal by multiplying the amplitude of each bin by its LC gain and by its ILD gain to create output gain signals. The respective output gains signals can then applied to the harmonic signals generated by per-band harmonics generators 540, 542, An exemplary structure for this processing is shown in detail below, with reference to FIG. 5*a*.

Harmonics unit 120 can include, for example, adder 550*a* and 550*b* (one adder for each channel), which can sum the harmonic signals from each hand.

Harmonics unit 120 can include, for example, an inverse fast Fourier transform (IFFT) component to convert the frequency domain harmonics signal to time domain. In some embodiments of the presently disclosed subject matter, the conversion can be accomplished via other methods, for example by sum of sinusoids as described in [4]. IFFT can be used with or without time overlap and/or by summing the bands of a filter-bank.

Harmonics unit 120 can optionally include up-sampling units 570—in ratio D—in order to restore the original sample rate.

It is noted that the teachings of the presently disclosed subject matter are not bound by the directionality-preserving bass enhancement system described with reference to FIG. 5. Equivalent and/or modified functionality can be consolidated or divided in another manner and can be implemented in any appropriate combination of software with firmware and/or hardware and executed on a suitable device. The harmonics unit (120) can be a standalone entity, or integrated, fully or partly, with other entities.

Attention is now drawn to FIG. 6, which illustrates a generalized flow diagram for exemplary frequency domain-based processing in harmonics unit 120, according to some embodiments of the presently disclosed subject matter.

The method described hereinbelow can be performed, by way of non-limiting example, on a system such as the one described above with reference to FIG. 5. The following description describes processing within a single frequency band, but the processing can take place, for example, on every frequency band as shown in FIG. 5.

The following description pertains to a method operating, for example, on a signal within the frequency domain—separated into bands which contain a fundamental frequency. Exemplary descriptions of how a frequency domain signal is obtained or how it is utilized are described above, with reference to FIG. 5 and FIG. 5*a*.

By way of non-limiting example, the original signal can appear as follows:

| Freq | fund | h1 | h2 | h3 | h4 |
|---|---|---|---|---|---|
| ch1 | 1.0 | 0 | 0 | 0 | 0 |
| ch2 | 0.5 | 0 | 0 | 0 | 0 |

The processing unit (100) (for example: harmonics level generators 540, 542) can—for each fundamental frequency in each channel signal, generate (610) a series of harmonic frequencies. In some embodiments of the presently disclosed subject matter, the processing unit (100) (for example: harmonics level generators 540, 542) generates, for example, series of harmonic lines up to the Nyquist frequency, with intensity of the frequencies equal to the fundamental frequency. Harmonic series can be generated, for example, by a harmonic generation algorithm such as pitch shift.

By way of non-limiting example, after harmonics generation (where ch1 is the reference signal), the signal can appear thus:

| Freq | fund | h1 | h2 | h3 | h4 |
|---|---|---|---|---|---|
| ch1 | 1.0 | 1.0 | 1.0 | 1.0 | 1.0 |
| ch2 | 0.5 | 0.5 | 0.5 | 0.5 | 0.5 |

In some embodiments of the presently disclosed subject matter, the processing unit (100) (for example: harmonics level generators 540, 542) can generate the harmonic series using a method that synchronizes the harmonic frequencies with phase of the fundamental (such as, by way of non-limiting example, the method described in Sanjaume, Jordi Bonada. Audio Time-Scale Modification in the Context of Professional Audio Post-production. Informàtica i Comunicació digital, Universitat Pompeu Fabra Barcelona. Barcelona, Spain, 2002, (p63, section 5.2.4). Such a method can, for example, ensure that the ITD of the harmonics signal substantially matches the ITD of the input signal so as to preserve directionality perceived by a listener.

Next, the processing unit (100) (for example: harmonics level control 530) can—for each fundamental frequency—determine (620) a reference signal (with a reference signal intensity) based on the input channel signals, loudness compensation value Next, the processing unit (100) (for example: harmonics level control 530) can determine (630) a loudness compensation value for each harmonic frequency in each channel, according to the loudness of the fundamental frequency in the reference signal.

A loudness compensation value a gain value to render the loudness of harmonic frequencies of the bin as, for example, substantially matching the loudness of the fundamental frequency of the band in channel iMax. The loudness value can be determined, for example, using a Sound Pressure Level-to-phons ratio based on Fletcher-Munson equal loudness contours.

Optionally, the processing unit (100) (for example: harmonics level control 530) can smooth the loudness compensation gains over time.

The processing unit (100) (for example: harmonics level control 530) can determine (640)—for each channel—for each harmonic frequency in the band, a directionality-preserving ILD compensation value i.e. a gain value to render the perceived ILD of the harmonic frequency (relative to the reference signal) as, for example, substantially matching the calculated ILD for the fundamental channel (relative to the reference signal).

To do this, the processing unit (100) (for example: harmonics level control 530) can first calculate—for each channel and for each band in the channel—an ILD of the fundamental frequency. It can do this, for example, by calculating the ratio between the level of the fundamental frequency in this channel in the input signal and level of the fundamental frequency in the reference signal.

By way of non-limiting example, continuing with the signal described above, the ILD of the fundamental is 0.5/1 i.e. 0.5.

Perceived ILD of a particular harmonic frequency can be assessed according to—for example—the actual observed ILD at the particular frequency, the particular frequency itself, and a model such as—for example—a head shadowing model such as the exemplary curve shown in FIG. 7. More specifically, the head-shadowing model described in Brown, C. P., Duda, R. O.: An efficient hrtf model for 3-D sound. In: Proceedings of the IEEE ASSP Workshop on Applications of Signal Processing to Audio and Acoustics, IEEE (1997) can, for example, be employed. The processing unit (100) (for example: harmonics level control 530) can thus select a gain value for which the perceived ILD according to the model substantially matches of the calculated ILD of the fundamental.

By way of non-limiting example, ILD compensation gains for the signal presented above—according to a head shadow curve in relation to the reference signal can be as follows:

| Freq | fund | h1 | h2 | h3 | h4 |
|---|---|---|---|---|---|
| ch1 | 1.0 | 1.0 | 1.0 | 1.0 | 1.0 |
| ch2 | 1.0 | 0.8 | 0.6 | 0.4 | 0.2 |

The processing unit (100) (for example: harmonics level control 530) can finally compute directionality-preserving compensation values by, for example, multiplying the calculated ILD of the fundamental by the calculated ILD compensation gains.

Optionally, processing unit (100) (for example: harmonics level control 530) can smooth the directionality-preserving compensation gains over time.

By way of non-limiting example, for the signal above, directionality-preserving compensation gain=(ILD of the fundamental×ILD compensation gains), and appears thus:

| Freq | fund | h1 | h2 | h3 | h4 | | level ratio | | fund | h1 | h2 | h3 | h4 |
|---|---|---|---|---|---|---|---|---|---|---|---|---|---|
| ch1 | 1.0 | 1.0 | 1.0 | 1.0 | 1.0 | × | 1.0 | = | 1.0 | 1.0 | 1.0 | 1.0 | 1.0 |
| ch2 | 1.0 | 0.8 | 0.6 | 0.4 | 0.2 | | 0.5 | | 1.0 | 0.4 | 0.3 | 0.2 | 0.1 |

It is noted that the teachings of the presently disclosed subject matter are not bound by the flow chart illustrated in FIG. 6, the illustrated operations can occur out of the illustrated order. It is also noted that whilst the flow chart is described with reference to elements of the system of FIG. 5, this is by no means binding, and the operations can be performed by elements other than those described herein.

It is to be understood that the invention is not limited in its application to the details set forth in the description contained herein or illustrated in the drawings. The invention is capable of other embodiments and of being practiced and carried out in various ways. Hence, it is to be understood that the phraseology and terminology employed herein are for the purpose of description and should not be regarded as limiting. As such, those skilled in the art will appreciate that the conception upon which this disclosure is based may readily be utilized as a basis for designing other structures, methods, and systems for carrying out the several purposes of the presently disclosed subject matter.

It will also be understood that the system according to the invention may be, at least partly, implemented on a suitably programmed computer. likewise, the invention contemplates a computer program being readable by a computer for executing the method of the invention. The invention further contemplates a non-transitory computer-readable memory tangibly embodying a program of instructions executable by the computer for executing the method of the invention.

Those skilled in the art will readily appreciate that various modifications and changes can be applied to the embodiments of the invention as hereinbefore described without departing from its scope, defined in and by the appended claims.

The invention claimed is:

1. A method of conveying to a listener a directionality-preserving pseudo low frequency psycho-acoustic sensation of a multichannel sound signal, comprising:

deriving from the sound signal, by a processing unit, a high frequency multichannel signal and a low frequency multichannel signal, the low frequency multichannel signal extending over a low frequency range of interest;

generating, by the processing unit, a multichannel harmonic signal, the loudness of at least one channel signal of the multichannel harmonic signal substantially matching the loudness of a corresponding channel in the low frequency multichannel signal; and at least one interaural level difference (ILD) of at least one frequency of at least one channel pair of the multichannel harmonic signal substantially matching an ILD of a corresponding fundamental frequency in a corresponding channel pair in the low frequency multichannel signal; and summing, by the processing unit, the harmonic multichannel signal and the high frequency multichannel signal thereby giving rise to a psychoacoustic alternative signal; wherein the generating a harmonic multichannel signal is in accordance with a method comprising:

i. for at least two channel signals of the low frequency multichannel signal, generating per-channel harmonics signals, each comprising at least one harmonic frequency of a fundamental frequency of the channel signal, ii. deriving a reference signal according to the low frequency multichannel signal, iii. generating a loudness gain adjustment according to a loudness of the reference signal, iv. generating an ILD gain adjustment for each of the per-channel harmonics signals, according to, at least, a level difference between the at least one channel signal and the reference signal, and v. applying the generated loudness gain adjustment and respective ILD gain adjustment to each of the per-channel harmonics signals.

2. The method of claim 1, wherein the generating of a loudness gain adjustment comprises: according to the per-channel harmonic signals, calculating a linked envelope, and applying a nonlinear gain curve to the linked envelope, resulting in a loudness gain adjustment; and the generating of a loudness gain adjustment comprises: for each of the per-channel harmonic signals, calculating an unlinked envelope, and applying a nonlinear gain curve to the unlinked envelope, resulting in an ILD gain adjustment.

3. The method of claim 1, wherein the generating a loudness gain adjustment comprises: for at least one frequency in each per-channel harmonic signal, generating a per-frequency loudness gain adjustment such that a loudness of the at least one frequency, adjusted according to the per-frequency loudness gain adjustment, substantially matches a loudness of a corresponding fundamental frequency of the reference signal; and the generating an ILD gain adjustment comprises: for the at least one frequency of each per-channel harmonic signal, calculating a per-frequency ILD gain adjustment such that an ILD of the at least one frequency of each per-channel harmonic signal, adjusted according to the per-frequency ILD gain adjustment, substantially matches an ILD of the fundamental frequency of the low frequency channel signal corresponding to the ILD of the fundamental frequency in the reference low frequency signal.

4. The method of claim 3, wherein the generating per-channel harmonic signals synchronizes the phase of the harmonic signals according to the phase of the low-frequency multichannel signal.

5. A method of conveying to a listener a directionality-preserving pseudo low frequency psycho-acoustic sensation of a multichannel sound signal, comprising:

deriving from the sound signal, by a processing unit, a high frequency multichannel signal and a low frequency multichannel signal, the low frequency multichannel signal extending over a low frequency range of interest;

generating, by the processing unit, a multichannel harmonic signal, the loudness of at least one channel signal of the multichannel harmonic signal substantially matching the loudness of a corresponding channel in the low frequency multichannel signal; and at least one interaural level difference (ILD) of at least one frequency of at least one channel pair of the multichannel harmonic signal substantially matching an ILD of a corresponding fundamental frequency in a corresponding channel pair in the low frequency multichannel signal; and summing, by the processing unit, the harmonic multichannel signal and the high frequency multichannel signal thereby giving rise to a psychoacoustic alternative signal; wherein the generating a harmonic multichannel signal is in accordance with a method comprising:

i. for at least two channel signals of the multichannel sound signal, generating per-channel harmonics signals, each comprising at least one harmonic frequency of a fundamental frequency of the channel signal;

ii. deriving a reference signal according to the low frequency multichannel signal;

iii. generating a gain adjustment according to a loudness of the reference signal and, at least, a level difference between the at least one channel signal and the reference signal; and iv. applying the gain adjustment to each of the per-channel harmonics signals.

6. The method of claim 5, wherein the generating of an ILD gain adjustment comprises: according to the per-channel harmonic signals, calculating a linked envelope, and applying a nonlinear gain curve to the linked envelope, resulting in a loudness and ILD gain adjustment.

7. A system of conveying to a listener a directionality-preserving pseudo low frequency psycho-acoustic sensation of a multichannel sound signal, the system comprising a processing unit, wherein the processing unit is configured to:

derive, from the sound signal, a high frequency multichannel signal and a low frequency multichannel signal, the low frequency multichannel signal extending over a low frequency range of interest;

generate a multichannel harmonic signal, the loudness of at least one channel signal of the multichannel harmonic signal substantially matching the loudness of a corresponding channel in the low frequency multichannel signal; and at least one interaural level difference (ILD) of at least one frequency of at least one channel pair of the multichannel harmonic signal substantially matching an ILD of a corresponding fundamental frequency in a corresponding channel pair in the low frequency multichannel signal; and sum the harmonic multichannel signal and the high frequency multichannel signal thereby giving rise to a psychoacoustic alternative signal;

wherein the generating a harmonic multichannel signal comprises:

i. for at least two channel signals of the low frequency multichannel signal, generating per-channel harmonics signals, each comprising at least one harmonic frequency of a fundamental frequency of the channel signal, ii. deriving a reference signal according to the low frequency multichannel signal, iii. generating a loudness gain adjustment according to a loudness of the reference signal, iv. generating an ILD gain adjustment for each of the per-channel harmonics signals, according to, at least, a level difference between the at least one channel signal and the reference signal, and v. applying the generated loudness gain adjustment and respective ILD gain adjustment to each of the per-channel harmonics signals.

8. The system of claim 7, wherein the generating a loudness gain adjustment comprises: according to the per-channel harmonic signals, calculating a linked envelope, and applying a nonlinear gain curve to the linked envelope, resulting in a loudness gain adjustment; and the generating a loudness gain adjustment comprises:

for each of the per-channel harmonic signals, calculating an unlinked envelope, and applying a nonlinear gain curve to the unlinked envelope, resulting in an ILD gain adjustment.

9. The system of claim 7, wherein the generating a loudness gain adjustment comprises:

for at least one frequency in each per-channel harmonic signal, generating a per-frequency loudness gain adjustment such that a loudness of the at least one frequency, adjusted according to the per-frequency loudness gain adjustment, substantially matches a loudness of a corresponding fundamental frequency of the reference signal; and the generating an ILD gain adjustment comprises:

for the at least one frequency of each per-channel harmonic signal, calculating a per-frequency ILD gain adjustment such that an ILD of the at least one frequency of each per-channel harmonic signal, adjusted according to the per-frequency ILD gain adjustment, substantially matches an ILD of the fundamental frequency of the low frequency channel signal corresponding to the ILD of the fundamental frequency in the reference low frequency signal.

10. The system of claim 7, wherein the generating per-channel harmonic signals synchronizes the phase of the harmonic signals according to the phase of the low-frequency multichannel signal.

11. The system of claim 7, wherein the at least one channel signal comprises all channel signals of the multichannel harmonic signal.

12. The system of claim 7, wherein the at least one interaural level difference comprises all interaural level differences of the at least one frequency.

13. A system of conveying to a listener a directionality-preserving pseudo low frequency psycho-acoustic sensation of a multichannel sound signal, the system comprising a processing unit configured to:

derive, from the sound signal, a high frequency multichannel signal and a low frequency multichannel signal, the low frequency multichannel signal extending over a low frequency range of interest;

generate a multichannel harmonic signal, the loudness of at least one channel signal of the multichannel harmonic signal substantially matching the loudness of a corresponding channel in the low frequency multichannel signal; and at least one interaural level difference (ILD) of at least one frequency of at least one channel pair of the multichannel harmonic signal substantially matching an ILD of a corresponding fundamental frequency in a corresponding channel pair in the low frequency multichannel signal; and sum the harmonic multichannel signal and the high frequency multichannel signal thereby giving rise to a psychoacoustic alternative signal; wherein the generating a harmonic multichannel signal comprises:

i. for at least two channel signals of the multichannel sound signal, generating per-channel harmonics signals, each comprising at least one harmonic frequency of a fundamental frequency of the channel signal;

ii. deriving a reference signal according to the low frequency multichannel signal;

iii. generating a gain adjustment according to a loudness of the reference signal and, at least, a level difference between the at least one channel signal and the reference signal; and iv. applying the gain adjustment to each of the per-channel harmonics signals.

14. The system of claim 13, wherein the generating an ILD gain adjustment comprises:

according to the per-channel harmonic signals, calculating a linked envelope, and applying a nonlinear gain curve to the linked envelope, resulting in a loudness and ILD gain adjustment.

15. A computer program product comprising a computer-readable non-transitory storage medium retaining program instructions, which program instructions when read by a processing unit cause the processing unit to perform a method of conveying to a listener a directionality-preserving pseudo low frequency psycho-acoustic sensation of a multichannel sound signal, the method comprising:

deriving, from the sound signal, a high frequency multichannel signal and a low frequency multichannel signal, the low frequency multichannel signal extending over a low frequency range of interest;

generating a multichannel harmonic signal, the loudness of at least one channel signal of the multichannel harmonic signal substantially matching the loudness of a corresponding channel in the low frequency multichannel signal; and at least one interaural level difference (ILD) of at least one frequency of at least one channel pair of the multichannel harmonic signal substantially matching an ILD of a corresponding fundamental frequency in a corresponding channel pair in the low frequency multichannel signal; and summing the harmonic multichannel signal and the high frequency multichannel signal thereby giving rise to a psychoacoustic alternative signal; wherein the generating a harmonic multichannel signal comprises:

i. for at least two channel signals of the low frequency multichannel signal, generating per-channel harmonics signals, each comprising at least one harmonic frequency of a fundamental frequency of the channel signal, ii. deriving a reference signal according to the low frequency multichannel signal, iii. generating a loudness gain adjustment according to a loudness of the reference signal, iv. generating an ILD gain adjustment for each of the per-channel harmonics signals, according to, at least, a level difference between the at least one channel signal and the reference signal, and v. applying the generated loudness gain adjustment and respective ILD gain adjustment to each of the per-channel harmonics signals.

16. The computer program product of claim 15, wherein the generating a loudness gain adjustment comprises:

according to the per-channel harmonic signals, calculating a linked envelope, and applying a nonlinear gain curve to the linked envelope, resulting in a loudness gain adjustment; and the generating a loudness gain adjustment comprises:

for each of the per-channel harmonic signals, calculating an unlinked envelope, and applying a nonlinear gain curve to the unlinked envelope, resulting in an ILD gain adjustment.

17. The computer program product of claim 16, wherein the generating a loudness gain adjustment comprises:

for at least one frequency in each per-channel harmonic signal, generating a per-frequency loudness gain adjustment such that a loudness of the at least one frequency, adjusted according to the per-frequency loudness gain adjustment, substantially matches a loudness of a corresponding fundamental frequency of the reference signal; and the generating an ILD gain adjustment comprises:

for the at least one frequency of each per-channel harmonic signal, calculating a per-frequency ILD gain adjustment such that an ILD of the at least one frequency of each per-channel harmonic signal, adjusted according to the per-frequency ILD gain adjustment, substantially matches an ILD of the fundamental frequency of the low frequency channel signal corresponding to the ILD of the fundamental frequency in the reference low frequency signal.

18. The computer program product of claim 17, wherein the generating per-channel harmonic signals synchronizes the phase of the harmonic signals according to the phase of the low-frequency multichannel signal.

19. A computer program product comprising a non-transitory computer-readable storage medium retaining program instructions, which program instructions when read by a processing unit cause the processing unit to perform a method of conveying to a listener a directionality-preserving pseudo low frequency psycho-acoustic sensation of a multichannel sound signal, the method comprising:

deriving, from the sound signal, a high frequency multichannel signal and a low frequency multichannel signal, the low frequency multichannel signal extending over a low frequency range of interest;

generating a multichannel harmonic signal, the loudness of at least one channel signal of the multichannel harmonic signal substantially matching the loudness of a corresponding channel in the low frequency multichannel signal; and at least one interaural level difference (ILD) of at least one frequency of at least one channel pair of the multichannel harmonic signal substantially matching an ILD of a corresponding fundamental frequency in a corresponding channel pair in the low frequency multichannel signal; and summing the harmonic multichannel signal and the high frequency multichannel signal thereby giving rise to a psychoacoustic alternative signal; wherein the generating a harmonic multichannel signal comprises:

i. for at least two channel signals of the multichannel sound signal, generating per-channel harmonics signals, each comprising at least one harmonic frequency of a fundamental frequency of the channel signal;

ii. deriving a reference signal according to the low frequency multichannel signal;

iii. generating a gain adjustment according to a loudness of the reference signal and, at least, a level difference between the at least one channel signal and the reference signal; and iv. applying the gain adjustment to each of the per-channel harmonics signals.

20. The computer program product of claim 19, wherein the generating an ILD gain adjustment comprises:

according to the per-channel harmonic signals, calculating a linked envelope, and applying a nonlinear gain curve to the linked envelope, resulting in a loudness and ILD gain adjustment.

* * * * *